United States Patent [19]

Wahle et al.

[11] Patent Number: 4,693,263

[45] Date of Patent: Sep. 15, 1987

[54] METHOD AND APPARATUS FOR MAKING A COMPOSITE STREAM FROM FIBROUS MATERIAL OF THE TOBACCO PROCESSING INDUSTRY

[75] Inventors: Günter Wahle, Reinbek; Dieter Ludszeweit, Hamburg, both of Fed. Rep. of Germany

[73] Assignee: Hauni-Werke Körber & Co. KG, Hamburg, Fed. Rep. of Germany

[21] Appl. No.: 836,313

[22] Filed: Mar. 5, 1986

[30] Foreign Application Priority Data

Mar. 16, 1985 [DE] Fed. Rep. of Germany ..... 3509612

[51] Int. Cl.[4] ..... A24C 5/18; A24C 5/39

[52] U.S. Cl. ..... 131/84.4; 131/84.1; 131/84.3; 131/108

[58] Field of Search ..... 131/84.1, 84.3, 84.4, 131/360, 361, 108

[56] References Cited

U.S. PATENT DOCUMENTS

| | | | |
|---|---|---|---|
| 3,795,249 | 3/1974 | Cristiani | 131/84.4 |
| 3,854,486 | 12/1974 | Molins et al. | 131/84.4 |
| 4,009,722 | 3/1977 | Wahle et al. | 131/84.4 |
| 4,373,538 | 2/1983 | Steiniger | 131/108 |
| 4,485,826 | 12/1984 | Holzangel | 131/84.4 |
| 4,516,585 | 5/1985 | Pinkham | 131/84.4 |
| 4,564,028 | 1/1986 | Heitmann | 131/84.4 |
| 4,605,013 | 8/1986 | Goldbach | 131/108 |
| 4,616,662 | 10/1986 | Hartmann et al. | 131/84.1 |

*Primary Examiner*—V. Millin
*Assistant Examiner*—H. Macey
*Attorney, Agent, or Firm*—Peter K. Kontler

[57] ABSTRACT

A composite tobacco stream which contains different types of tobacco is formed by converting fibrous material of a first type into a first succession of discrete batches and by converting fibrous material of a second type into a second succession of discrete batches. The two types of batches are thereupon shuffled in such a way that the resulting stream contains alternating batches consisting of first and second fibrous materials. The stream is equalized, draped into a web of cigarette paper and subdivided into cigarettes of unit length or multiple unit length. The shuffling step can be carried out on a rotating wheel-shaped conveyor or on a foraminous belt conveyor.

38 Claims, 8 Drawing Figures

METHOD AND APPARATUS FOR MAKING A COMPOSITE STREAM FROM FIBROUS MATERIAL OF THE TOBACCO PROCESSING INDUSTRY

CROSS-REFERENCE TO RELATED CASES

The apparatus of the present invention includes parts and groups of parts which are similar to those disclosed in commonly owned copending patent application Ser. No. 836,387 of Manfred Goldbach et al. filed Mar. 5, 1986 and in the U.S. patents and patent applications which are mentioned in the application of Goldbach et al.

BACKGROUND OF THE INVENTION

The invention relates to a method of and to an apparatus for making a composite stream from fibrous material of the tobacco processing industry. More particularly, the invention relates to improvements in a method of and in an apparatus for making a stream of fibrous material wherein batches consisting of or containing fibrous material of a first type alternate with batches or accumulations consisting of or containing fibrous material of a second type. Still more particularly, the invention relates to improvements in a method of and in an apparatus for making a stream of comminuted natural, substitute and/or reconstituted tobacco wherein portions consisting of high-quality tobacco alternate with portions consisting of lower-quality tobacco or tobacco having other characteristics which deviate from those of high-quality tobacco.

The term "fibers" is intended to embrace all kinds of fibrous materials which are used in the tobacco processing industry, such as natural, reconstituted or artificial tobacco or substitute tobacco (for example, cellulose) as well as fibers which can be utilized to make filters for tobacco smoke. If the fibrous material is tobacco, it can consist of arromatic tobacco particles with a high or low nicotine content or of relatively mild tobacco which may have a high or low nicotine content.

Commonly owned U.S. Pat. No. 4,009,722 to Wahle et al. and commonly owned patent application Ser. No. 575,169 (filed Jan. 30, 1984 by Goldbach) disclose apparatus for accumulating tobacco shreds into batches which are thereupon converted into portions of a continuous tobacco stream wherein the batches alternate with accumulations consisting of a different type of tobacco. The batches are formed in the pockets of a rotary wheel and are transferred onto a belt conveyor in such a way that neighboring batches of the resulting single file of batches are separated from each other by gaps of predetermined length. The file of batches is transported past a duct which showers tobacco particles not only onto the batches but also into the gaps between neighboring batches so that the fibrous material which accumulates in the gaps constitutes a second file of batches consisting of a different type of fibrous material The resulting stream has an undulate outline and, therefore, it must be trimmed by removing the surplus prior to draping it into a web of cigarette paper or the like so as to form a continuous rod which is thereupon subdivided into plain cigarettes of unit length or multiple unit length.

A drawback of presently known apparatus for making a composite stream wherein batches containing a first type of fibrous material alternate with batches or accumulations containing a second type of fibrous material is that the quantity of surplus fibrous material in the stream is very high so that a large mass of removed fragments of tobacco leaves or other fibrous material must be recovered and recirculated for renewed use. This affects the economy of the operation and the quality of the recirculated fibrous material.

OBJECTS AND SUMMARY OF THE INVENTION

An object of the invention is to provide a novel and improved method of forming a composite stream which consists of or contains tobacco or other fibrous material of the tobacco processing industry and which can be formed practically without any or with negligible recirculation of fibrous material.

Another object of the invention is to provide a method which renders it possible to form a composite stream that requires a minimum of trimming and can be converted into a homogeneous rod-like filler to form part of a cigarette rod or a rod which can be subdivided into cigarillos, cigars or like rod-shaped articles of the tobacco processing industry.

A further object of the invention is to provide a method which can be practiced with a relatively simple apparatus and renders it possible to accurately select the density and/or other desirable parameters of various sections of the composite stream.

Still another object of the invention is to provide a novel and improved method of making a continuous cigarette rod wherein the filler contains different types of smokable material.

A further object of the invention is to provide a novel and improved apparatus for the practice of the above outlined method, and to construct and assemble the apparatus in such a way that the percentage of fibrous material which is not accepted for the making of batches is a small fraction of non-accepted material in conventional apparatus.

An additional object of the invention is to provide the apparatus with novel and improved means for forming a composite stream wherein batches or similar accumulations consisting of or containing a first fibrous material alternate with batches or similar accumulations consisting of or containing a second fibrous material.

An additional object of the invention is to provide the apparatus with novel and improved means for treating the composite stream on its way toward the draping station.

Another object of the invention is to provide an apparatus which can be used for mass production of plain or filter cigarettes with or without dense ends.

Still another object of the invention is to provide an apparatus wherein a composite stream can be formed in a small area, with relatively simple components and at the rate which is required in a modern cigarette making or like plant.

A further object of the invention is to provide an apparatus which can densify different sections or portions of the composite stream to a desired extent and which can maintain each and every increment of the filler in a cigarette rod or the like within a predetermined density range.

A further object of the invention is to provide the apparatus with novel and improved means for assembling batches containing a first type of fibrous material with batches containing a different second type of fibrous material.

An additional object of the invention is to provide an apparatus wherein the fibrous material need not be showered so that the direction of movement of fibrous material can be controlled with a high degree of accuracy, and wherein fibrous material of one type is not permitted to overlie fibrous material of the other type so that the surplus (if any) can be separated in such a way that fibrous material of one type is not intermixed with fibrous material of the other type.

A further object of the invention is to provide an apparatus which can produce a tobacco stream wherein batches containing different types of tobacco particles do not overlap each other and wherein particles of fibrous material need not be showered into gaps between spaced-apart batches.

One feature of the invention resides in the provision of a method of making a stream of fibrous material, particularly a stream of smokable fibrous material. The method comprises the steps of accumulating first batches from a first fibrous material, gathering second batches from a second fibrous material, and shuffling the first and second batches to form a composite stream wherein first batches alternate with second batches. The shuffling step can comprise advancing first batches along an elongated path in the form of a single file wherein neighboring first batches define gaps, and inserting discrete second batches between successive first batches of the file.

The composite stream is preferably formed from elongated batches, and the shuffling step includes placing the second batches end-to-end with the neighboring first batches.

The accumulating step can comprise feeding first fibrous material into successive pockets of a series of pockets on a first circulating conveyor, the gathering step can comprise feeding second fibrous material into successive pockets of a series of pockets on a discrete second circulating conveyor, and the shuffling step can comprise transferring first and second batches from the pockets of the first and second conveyors onto an endless belt conveyor. The circulating conveyors may constitute rotary wheels having peripheral surfaces with recesses which constitute the pockets. The method preferably further comprises the step of positioning the belt conveyor substantially tangentially of the wheels.

In accordance with a modified method, the first accumulating step includes feeding first fibrous material into alternate pockets of an annulus of pockets on a single circulating conveyor, and the gathering step comprises feeding second fibrous material into the pockets between the alternate pockets so that the thus filled pockets contain a single file of alternating first and second batches. The shuffling step of this method preferably comprises transferring first and second batches from successive pockets of the single circulating conveyor onto an endless belt conveyor so that the transferred batches together form the composite stream.

In accordance with another modification of the method, the accumulating step can comprise forming a series of first layers from first fibrous material and converting each first layer into a first batch, and the gathering step preferably comprises forming a series of second layers from second fibrous material and converting each second layer into a second batch. The converting step of such method can include pneumatically increasing the thickness and simultaneously reducing the width of the respective layers.

The endless belt conveyor which can be used to carry out of the shuffling step can constitute a foraminous belt conveyor which can advance the composite stream along a predetermined path. The advancing step can include establishing a pressure differential between the opposite sides of the conveyor.

The method preferably further comprises the step of equalizing the composite stream. Still further, the method can comprise the step of draping the equalized stream into a web of wrapping material. The equalizing step can comprise removing fibrous material from the composite stream.

In accordance with one presently preferred embodiment of the method, the equalizing step can comprise trimming the composite stream in such a way that fibrous material is removed from at least some of the batches which form the composite stream in such quantities that each first batch contains a first quantity of first fibrous material and each second batch contains a different second quantity of second fibrous material. The trimming or equalizing step preferably includes removing fibrous material from each of the batches in the stream so that all trimmed first batches contain identical first quantities of first fibrous material and all trimmed second batches contain identical second quantities of second fibrous material. Such method preferably further comprises the steps of monitoring the quantities of fibrous material in the trimmed batches and changing the rate of material removal when the monitored quantities deviate from at least one predetermined value. In accordance with such method, the trimming or equalizing step preferably includes removing fibrous material from successive first batches of the composite stream at a first location and removing fibrous material from successive second batches of the composite stream at a second location. The monitoring step can include generating first signals denoting the monitored quantities of fibrous material in the first batches and generating second signals denoting the monitored quantities of fibrous material in the second batches. The changing step then preferably comprises comparing the first signals with a first reference signal, changing the rate of material removal at the first station when the first signals deviate from the first reference signal, comparing the second signals with a second reference signal, and changing the rate of material removal at the second location when the second signals deviate from the second reference signal.

Another feature of the invention resides in the provision of an apparatus for making a stream of fibrous material, particularly a stream of smokable fibrous material. The apparatus comprises means for accumulating a succession of first batches from a first fibrous material, means for gathering a second fibrous material into a succession of second batches, and means for shuffling the first and second batches so as to form a composite stream wherein first batches alternate with second batches. The accumulating means can comprise a first circulating conveyor, and the gathering means can comprise a discrete second circulating conveyor. Each of the circulating conveyors can constitute a rotary wheel having a peripheral surface with an annulus of pockets. The accumulating means then further comprises means for feeding first fibrous material into successive pockets of the wheel forming part of the accumulating means, and the gathering means further comprises means for feeding second fibrous material into successive pockets of the respective wheel.

In accordance with a modification, the accumulating means and the forming means can comprise a common rotary wheel-shaped conveyor having an annulus of pockets. The accumulating means then further comprises first feeding means for supplying first fibrous material into alternate pockets of the annulls of pockets at a predetermined location adjacent to the path of movement of the pockets, and the gathering means further comprises means for supplying second fibrous material to the pockets which remain empty while moving past the afore-mentioned location. The shuffling means of such apparatus can comprise an endless belt conveyor and means for transferring batches from successive pockets of the wheel onto the belt conveyor. The transferring means preferably comprises means for attracting the batches to the conveyor by suction. In such apparatus, at least one of the accumulating and gathering means can comprise means for forming layers from fibrous material and means for converting the layers into discrete batches. The converting means can comprise means for pneumatically increasing the thickness and for simultaneously reducing the width of the layers.

The apparatus preferably further comprises means for equalizing the composite stream and means for draping the equalized composite stream into a web of cigarette paper or other suitable wrapping material. The equalizing means preferably comprises means for removing fibrous material from at least some batches of the composite stream. The equalizing means can comprise a first trimming or equalizing unit having means for removing fibrous material from successive first batches of the composite stream so that each equalized first batch contains a first quantity of fibrous material, and a second trimming or equalizing unit having means for removing fibrous material from successive second batches of the composite stream so that each equalized second batch contains a different second quantity of fibrous material. Such apparatus preferably further comprises means for monitoring the quantities of fibrous material in the equalized batches, means for adjusting the first trimming unit when the monitored quantities of fibrous material in the first batches deviate from a first predetermined value, and means for adjusting the second trimming unit when the monitored quantities of fibrous material in the second batches deviate from a second predetermined value.

The means for equalizing the composite stream is preferably adjustable so that it can conform the mass and/or density of fibrous material in successive increments of the composite stream to a predetermined optimum value. In its simplest form, the means for equalizing the composite stream can comprise a single trimming device which removes material from all of the batches, means for monitoring the quantities of fibrous material in the batches of the equalized stream, and means for adjusting the equalizing means when the monitored quantities deviate from predetermined values.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
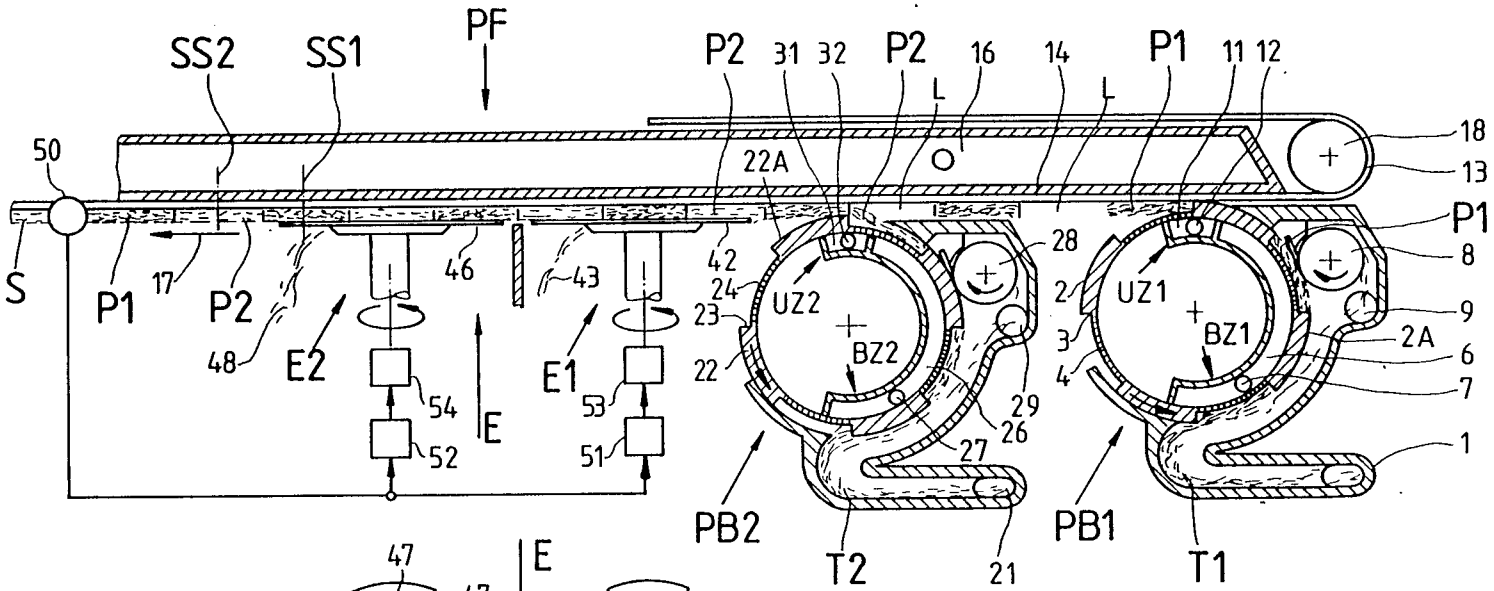
FIG. 1 is a fragmentary partly elevational and partly vertical sectional view of an apparatus which uses two rotary wheel-shaped batch forming conveyors and embodies one form of the invention.
Figure 2:
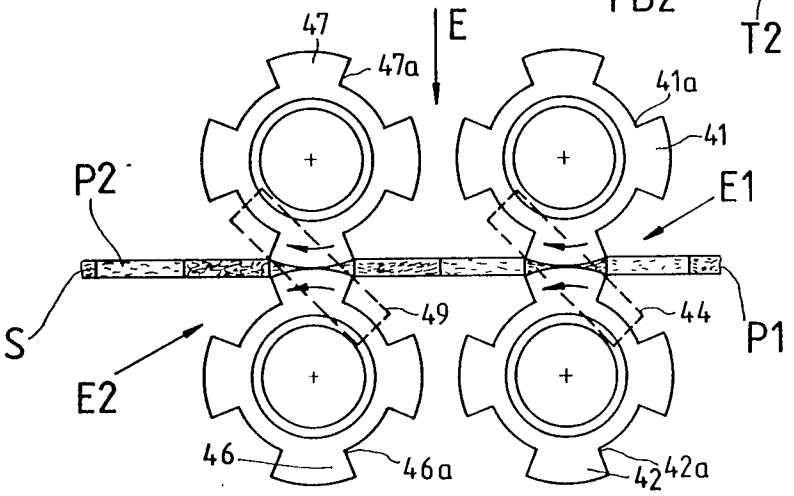
FIG. 2 is a larger-scale view as seen in the direction of arrow PF in FIG. 1 and shows the two trimming units of the equalizing device for the composite stream.

Referring first to FIGS. 1 and 2, there is shown an apparatus which serves to produce a continuous composite stream S wherein batches P1 or similar accumulations consisting of a first fibrous material T1 alternate with batches P2 or similar accumulations consisting of a different second fibrous material T2. The material T1 of the batches P1 is or can be tobacco, and the same applies for the material T2 of the batches P2. The composite stream S is equalized by an adjustable trimming or equalizing device E before it enters a draping station (not shown) wherein it is draped into a web of cigarette paper or other suitable wrapping material in a conventional manner to constitute the filler of the resulting cigarette rod which is thereupon subdivided into plain cigarettes of unit length or multiple unit length. The cigarettes can be admitted into a filter tipping machine to be converted into filter cigarettes of unit length. The reference characters SS1 and SS2 denote the planes in which the filler of the just discussed rod is severed transversely of the stream S so that each plain cigarette contains a portion of a batch P1 and a portion of a batch P2. The length of the cigarette portion containing the first fibrous material T1 may but need not match the length of the cigarette portion containing the second fibrous material T2. The draping station and the severing or subdividing station can be identical with those in the cigarette making machine which is known as PROTOS and is made by the assignee of the present application.

The apparatus of FIGS. 1 and 2 comprises a first batch forming unit PB1 which includes a pneumatic conveyor 1 serving as a means for feeding fibrous material T1 of the first type into the range of a circulating batch forming conveyor in the form of rotary wheel 2 having a series of recesses in the form of elongated pockets 3 machined or otherwise formed in its peripheral surface 2A. The pneumatic conveyor 1 can receive an equalized homogeneous narrow stream of fibrous material T1 from a suitable source, such as a distributor of the type described in commonly owned U.S. Pat. No. 4,373,538 to Steiniger. The disclosure of this patent, as well as of any other patent and patent application mentioned in this application, is incorporated herein by reference.

The wheel 2 surrounds a stationary suction chamber 6 which is connected with a fan or another suitable suction generating device (not shown) by a conduit 7. The bottom walls 4 of the pockets 3 are perforated so that the suction chamber 6 can attract fibrous material T1 into successive pockets 3 while such pockets travel along the corresponding portion of their path (such portion of the path extends from the six o'clock position to the two o'clock position, as viewed in FIG. 1). The zone or station wherein the pockets 3 are filled with fibers T1 is denoted by the character BZ1. The character UZ1 denotes the transfer zone or station where finished batches P1 are transferred from successive pockets 3 to the underside of the lower reach of a driven endless foraminous belt conveyor 13 which is trained over pulleys 18 (only one shown in FIG. 1) so that its lower reach extends tangentially of the wheel 2 and a second wheel 22. The transfer station UZ1 accommodates a plenum chamber 11 which is connected to a source of compressed air (not specifically shown) by a conduit 12. Successive batches P1 are trimmed or equalized by a preferably adjustable trimming or equalizing device 8 which is installed downstream of the filling station BZ1 and can comprise a stationary cutter cooperating with the peripheral cutting edges of a rotary cutter as disclosed in the commonly owned copending patent application Ser. No. 666,365 of Rudszinat. The reference character 9 denotes a return conduit which delivers the non-accepted fibrous material T1 to the source, such as the magazine of the aforementioned distributor of Steiniger. The trimming device 8 (which employs a stationary cutter and a rotary cutter) can be replaced with a simpler trimming device, e.g., a rotary brush. All that counts is to insure that the batches P1 are properly homogenized and equalized before they reach the elongated path which is defined by the lower reach of the belt conveyor 13 and along which the batches P1 advance in such a way that they develop elongated gaps L each of which may but need not be as long as (and can be longer than) a batch P1. The single file of batches P1 at the underside of the lower reach of conveyor 13 is thereupon transported toward and into the range of a second batch forming unit PB2.

The return conduit 9 preferably extends through a suitable cyclone separator which segregates the gaseous carrier medium (normally air) from the non-accepted fibrous material T1 before the fibrous material is returned into the magazine of the distributor. The transfer station UZ1 is located at the twelve o'clock position of the wheel 2 and is located immediately downstream of the respective end of the suction chamber 6. The pressure in the plenum chamber 11 need not appreciably exceed atmospheric pressure, as long as it ensures or assists in reliable transfer of successive batches P1 onto the conveyor 13. The lower reach of the conveyor 13 travels along the perforated bottom wall 14 of a stationary suction chamber 16 which attracts the batches P1 to the underside of the lower reach and ensures that the width of the gaps L remains unchanged while the batches P1 advance toward, past and beyond the second batch forming unit PB2. The direction in which the batches P1 advance is indicated by the arrow 17.

The wheel 2 and the pneumatic conveyor 1 constitute a means for accumulating a succession of batches P1 from the fibrous material T, and the conveyor 13 constitutes a means for converting the batches P1 and the batches P2 into the composite stream S.

The batch forming unit PB2 of FIG. 1 comprises a pneumatic conveyor 21 which feeds a preferably homogenized and equalized narrow stream of second fibrous material T2 into the range of a stationary suction chamber 26 within the confines of the second rotary wheel 22 whose peripheral surface 22A has pockets 23 with perforated bottoms 24. The pocket filling station is denoted by the character BZ2, and the transfer station for batches P2 is denoted by the character UZ2. The suction chamber 26 is connected with a suction generating device by way of a conduit 27 and terminates immediately upstream of a plenum chamber 31 which is connected with a source of compressed air by a conduit 32. The character 28 denotes a brush, a rotary metallic tool or any other suitable preferably adjustable equalizing or trimming device which can remove the surplus from successively formed batches P2, and the fibrous material T2 which is not accepted by the pockets 23 is returned to the corresponding distributor (which can be identical with the distributor of Steiniger) which receives such fibrous material from a return conduit 29. The conduit 29 preferably passes through a cyclone separator which segregates the gaseous carrier medium from fibrous material T2 before the material returns into the magazine of the corresponding distributor.

The wheel 22 and the pneumatic conveyor 21 together constitute a means for gathering a succession of batches P2 from fibrous material T2.

The operation of the batch forming unit PB2 is synchronized with the operation of the batch forming unit PB1 in such a way that successive pockets 23 of the wheel 22 deliver freshly formed batches P2 into successive gaps L between the batches P1 of the single file of batches P1 at the underside of the lower reach of the conveyor 13. This completes the formation of the composite rod S.

The transfer of batches P2 into the oncoming gaps L is effected by superatmospheric pressure in the plenum chamber 31 as well as by suction in the chamber 16. Suction in the chamber 16 above the wheel 22 entails a desirable slight loosening of fibrous material T2 which forms the batches P2 while the batches are being transferred from the respective pockets 23 onto the lower reach of the conveyor 13.

By way of example, the batches P1 can consist of a mild tobacco with a high or low nicotine content, and batches P2 can consist of a fragrant tobacco with a higher nicotine content. The positions of the cutting planes SS1 and SS2 can be selected in such a way that each plain cigarette of unit length contains a portion of a batch P2 adjacent to the end which is to be lighted by the smoker and a portion of a batch P1 in the region adjacent to the mouth of the smoker.

The equalizing device E comprises two discrete trimming or equalizing units E1 and E2. The arrangement is such that the trimming unit E1 removes exclusively or primarily fibrous material T1 of the batches P1, and the trimming unit E2 removes solely or nearly exclusively fibrous material T2. This is desirable and advantageous because the surplus 43 which is removed by the trimming unit E1 need not contain a mixture of fibrous materials T1 and T2 but contains only fibrous material T1. Analogously, the shower 48 which is formed by the trimming unit E2 contains exclusively or parimarily fibrous material T2.

Each of the trimming units E1 and E2 is adjustable, i.e. it is movable up and down nearer to and further away from the lower reach of the conveyor 13 so as to alter the plane in which certain fibers of the batches P1 are clamped by the rotary discs 41, 42 of the trimming unit E1 and the plane in which the discs 46, 47 of the trimming unit E2 clamp certain fibers of successive batches P2. As can be seen in FIG. 2, the arrangement is such that the discs 41 and 42 clamp fibrous material T1 of successive batches P1 in the selected trimming plane and the material (surplus 43) which extends beyond such plane is removed by a rotating brush 44, a rotating cutting tool or any other device which can brush, sweep or sever the surplus 43 away from the major portions of the respective batches P1. The situation is analogous in connection with the trimming of batches P2 by the discs 46, 47 and a brush or another removing tool 49 of the trimming unit E2. The peripheries of the discs 41 and 42 are respectively formed with relatively deep recesses 41*a* and 42*a* which ensure that the tool 44 of the trimming unit E1 cannot remove fibrous material T2 from the batches P2. Analogously the discs 46, 47 of the trimming unit E2 have relatively deep recesses 46*a* and 47*a* which ensure that the tool 49 cannot remove fibrous material T1 from the already trimmed batches P1. The composite stream S at the underside of the lower reach of the conveyor 13 advances substantially tangentially of the clamping discs 41, 42 and 46, 47. Clamping discs with recesses are disclosed in commonly owned U.S. Pat. No. 4,485,826 to Holznagel. A similar trimming device but without recesses in the clamping discs is disclosed in commonly owned U.S. Pat. No. 4,564,028 to Heitmann.

The surplus 43 is returned to the source of fibrous material T1, and the surplus 48 is returned to the source of fibrous material T2.

The clamping discs 41, 42 and 46, 47 can be formed with additional recesses so as to provide selected portions of the composite stream S with protuberances which are depressed into the major portion of the filler in the aforementioned draping unit so that the draped filler contains longitudinally spaced apart portions of greater density. The cigarette rod is then severed across or adjacent to the denser portions so that the resulting cigarettes have so-called dense ends. Reference may be had to the aforementioned commonly owned patent to Holznagel.

The apparatus of FIGS. 1 and 2 further comprises a monitoring device 50 which is designed to generate signals denoting the densities of successive batches P1 and P2. The monitoring device 50 preferably transmits discrete signals which respectively denote the densities of successive batches P1 and the densities of successive batches P2. Such signals are utilized to actuate the adjusting motors 53, 54 for changing the rate of removal of fibrous material by the trimming units E1, E2 via control units 51, 52, preferably in such a way that the level of the trimming unit E1 can be adjusted independently of the level of the trimming unit E2 and vice versa. This renders it possible to ensure that the density of trimmed batches P1 deviates (if necessary) from the density of trimmed batches P2. The monitoring device 50 can monitor the density (mass per unit length) of the trimmed or equalized stream S. Suitable monitoring devices are manufactured by the assignee of the present application. They can operate with a source of corpuscular radiation (for example, beta rays) and are often used in machines for the processing of tobacco. The control units 51, 52 preferably comprise suitable sources (for example, adjustable potentiometers) of reference signals and means for comparing each signal from the monitoring device 50 with a reference signal so as to adjust the respective motor 53, 54 (and hence the respective trimming unit E1, E2) only when the intensity and/or another characteristic of the signal which is transmitted by the monitoring device 50 deviates from a preselected optimum value. The manner in which the transmission of first and second signals from the monitoring device 50 to the control units 51 and 52 is synchronized with the speed of the conveyor 13 (so that the recesses 41*a*, 42*a* register with the batches P2 and the recesses 46*a*, 47*a* register with the batches P1) is well known in the field of testing rod-shaped articles of the tobacco processing industry.

Figure 3:
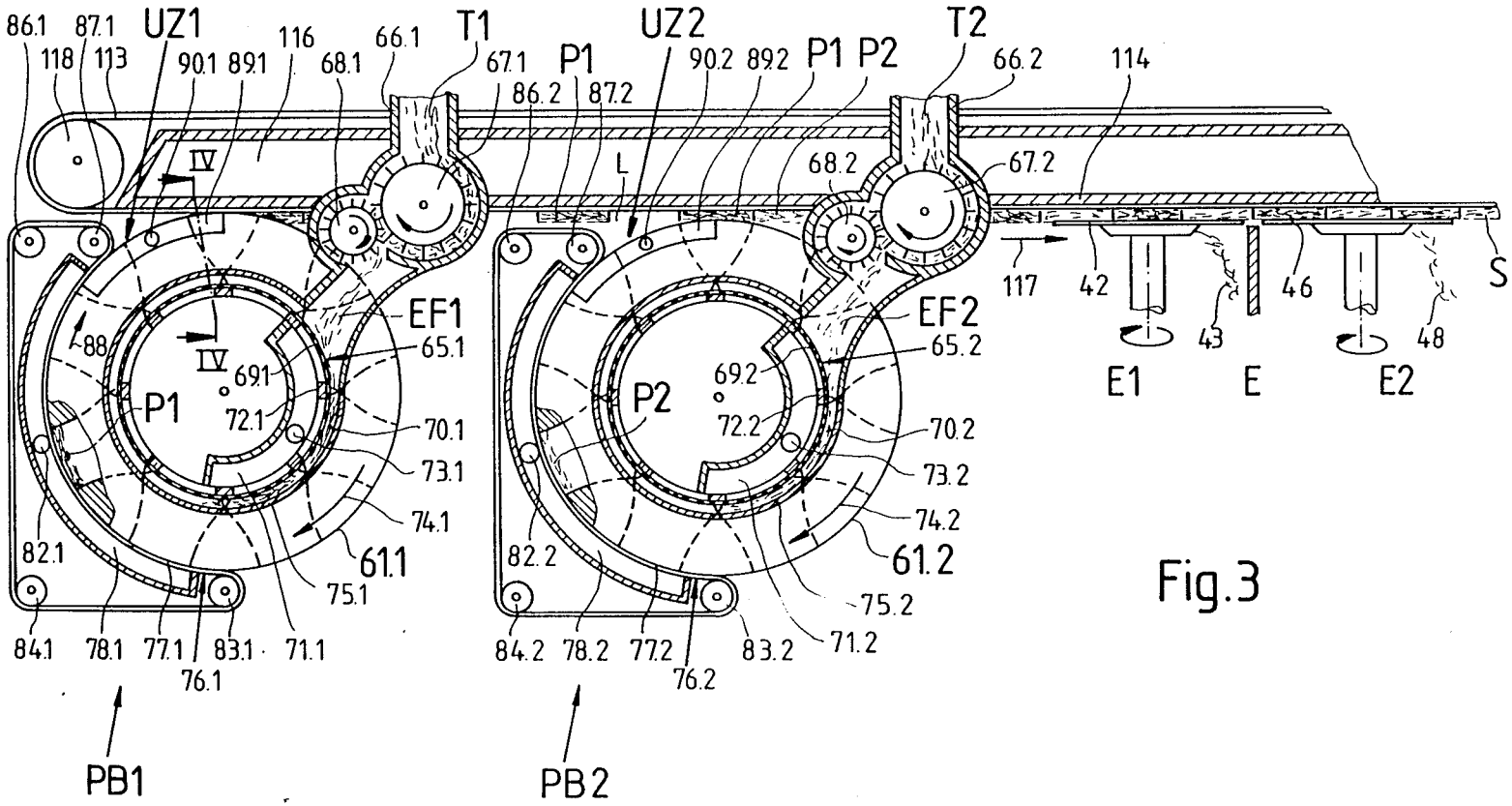
FIG. 3 is a fragmentary partly elevational and partly vertical sectional view of an apparatus with two modified wheel-shaped batch forming conveyors.
Figure 5:
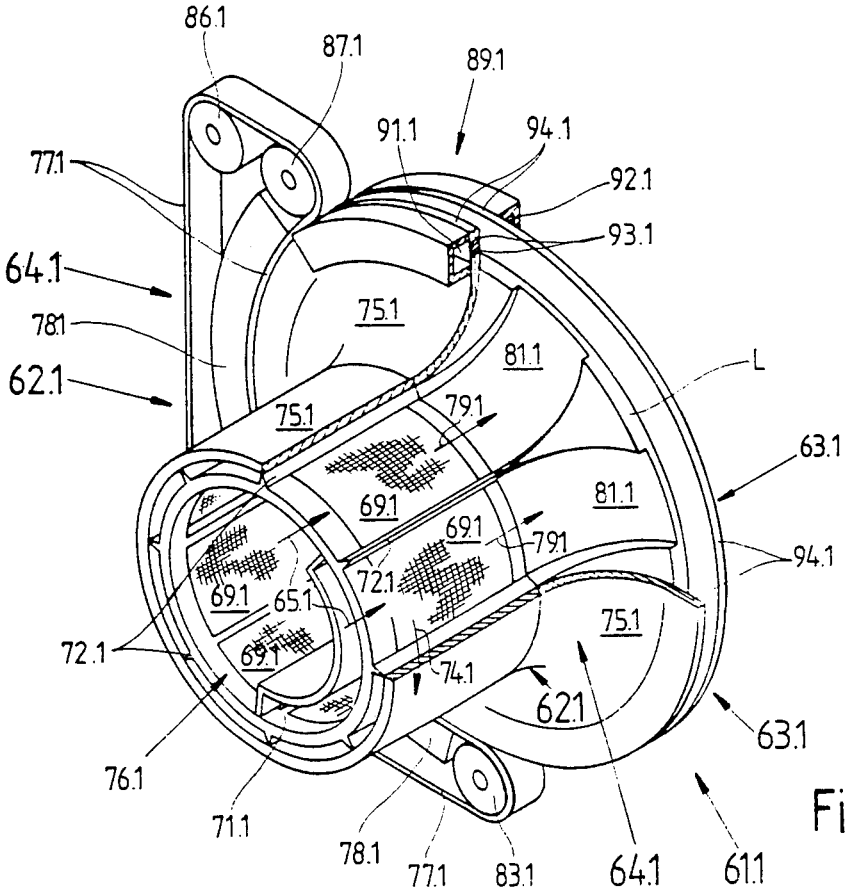
FIG. 5 is an enlarged perspective view of one of the batch-forming conveyors shown in FIG. 3.
Figure 4:
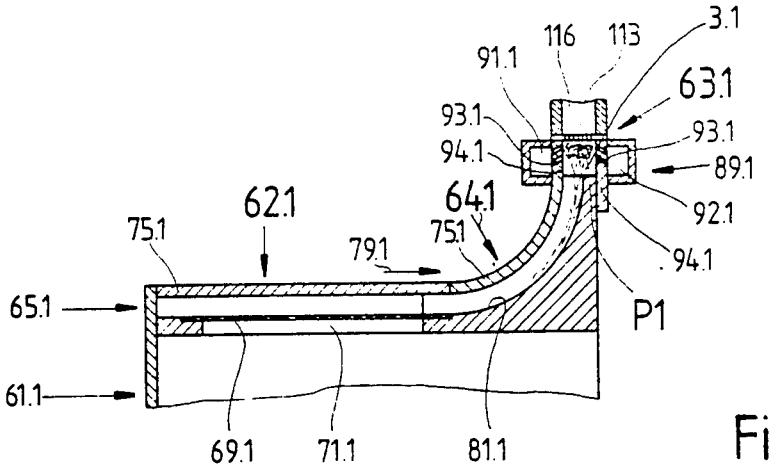
FIG. 4 is an enlarged fragmentary sectional view as seen in the direction of arrows from the line IV—IV in FIG. 3.

FIGS. 3 to 5 illustrate a modified apparatus with batch forming units PB1 and PB2 wherein the incoming fibrous materials T1 and T2 are first converted into thin layers or carpets of fibers and such layers are then converted into discrete batches P1 and P2, respectively. An advantage of the apparatus of FIGS. 3 to 5 is that the percentage of non-accepted fibers which must be recirculated to the magazines of the respective distributors is reduced to a minimum or to zero.

Since the batch forming unit PB2 is identical with the unit PB1, only the unit PB1 will be described in detail. This unit comprises a wheel-shaped conveyor 61.1 which rotates in the direction of arrow 74.1 and includes a layer forming portion 62.1 followed by a batch forming portion 63.1, as considered in the axial direction of the conveyor 61.1. The portions 62.1 and 63.1 are connected to each other by an intermediate portion 64.1 which extends in part axially and in part radially of the conveyor 61.1.

The layer forming portion 62.1 comprises a plurality of layer- or fleece-forming sections or zones 65.1 each of which can accumulate a thin layer 70.1 of fibers T1 which are thereupon converted into batches P1 by pneumatically increasing their thickness and simultaneously reducing their width. The thickness is measured in the radial direction and the width is measured in the axial direction of the conveyor 61.1. The sections 65.1 receive fibrous material T1 (preferably tobacco) from a feeding duct 66.1 which directs the particles of material T1 onto the carding of a driven carded drum 67.1 cooperating with a rapidly driven picker roller 68.1. The latter serves to expel fibrous material T1 from the carding of the drum 67.1 and to propel the particles onto successive sections 65.1. Such sections are separated from each other by axially extending partitions in the form of ribs 72.1.

The sections 65.1 have foraminous bottoms 69.1 each of which can constitute a layer of porous textile material or a metallic or plastic plate with suitably distributed holes therein. The sections 65.1 surround a stationary suction chamber 71.1 which draws air through the bottoms 69.1 and thereby attracts fibrous material T1 to the outer sides of such bottoms. Each layer 70.1 has a constant thickness and covers the entire bottom 69.1 of the respective section 65.1. The suction chamber 71.1 is connected to a non-illustrated suction generating device (for example, a fan) by way of a conduit 73.1.

The location where the fibrous material T1 impinges upon successive bottoms 69.1 under the action of the picker roller 68.1 is denoted by the character EF1. The location EF1 is adjacent to a cover or shroud 75.1 which overlies the oncoming bottoms 69.1 and the layers 70.1 on such bottoms and assists a further suction chamber 78.1 to draw the material T1 of the layers 70.1 in the directions of arrows 79.1 toward and into the portion 63.1 of the conveyor 61.1. This results in the conversion of layers 70.1 into discrete batches P1.

The actual batch forming station is shown at 76.1. This station accommodates the stationary arcuate suction chamber 78.1 which is adjacent to a curved portion of a foraminous endless belt conveyor 77.1. The latter is trained over a plurality of pulleys including those shown at 83.1, 84.1, 86.1 and 87.1. The orientation of the suction chamber 71.1 with reference to the suction chamber 78.1 is such that the chamber 71.1 ceases to attract the layers 70.1 at the time such layers reach the respective end of the suction chamber 78.1. This enables the chamber 78.1 to draw fibrous material T1 off the layers 70.1 and in the directions which are indicated by the arrows 79.1 so as to introduce the resulting batches P1 into the path which is defined by the concave outer side of the adjacent portion of the continuously driven belt conveyor 77.1. The chamber 78.1 is connected to the intake of a suction generating device (not shown) by a conduit 82.1.

The conveyor 61.1 is formed with a suitably curved surface 81.1 which extends first axially and thereupon radially (in the intermediate portion 64.1) so as to allow for smooth conversion of the thin layers 70.1 into much thicker but much narrower batches P1. This can be readily seen in FIG. 4. The portion 63.1 of the conveyor 61.1 is located in the plane of FIG. 3.

If desired and necessary, separation of fibrous material T1 from the respective bottoms 69.1 can be facilitated or promoted by the provision of one or more relatively short plenum chambers in the region between the suction chambers 71.1 and 78.1. The pressure in such plenum chamber or chambers need not appreciably exceed atmospheric pressure. The manner in which the suction chamber 78.1 is connected to a suitable suction generating device (for example, to the fan which draws air from the suction chamber 71.1) is not specifically shown.

The belt conveyor 77.1 is driven in the direction of arrow 88 and advances the thus formed single file of batches P1 along an arcuate path. Successive increments of the belt conveyor 77.1 are deflected by the pulley 87.1 so as to move away from the periphery of the conveyor 61.1 at a transfer station UZ1 so that the batches P1 which advance beyond the pulley 87.1 (as considered in the direction indicated by the arrow 88) can readily follow suction in a suction chamber 116 and leave the respective pockets 3.1 of the conveyor 61.1 on their way toward and into the elongated path which is defined by the lower reach of a foraminous belt conveyor 113. The latter is trained over pulleys 118 (one shown).

Holding means 89.1 can be provided at the transfer station UZ1 to ensure predictable transfer of successive batches P1 from the belt conveyor 77.1 onto the belt conveyor 113. The holding means 89.1 is disposed downstream of the suction chamber 78.1 (as considered in the direction of arrow 88) and its construction is shown in FIGS. 4 and 5. This holding means comprises two stationary suction chambers 91.1 and 92.1 which are connected to a suction generating device (not shown) by conduits 90.1 and can act upon the adjacent batches P1 via ports 93.1 which are provided in the adjacent cheeks 94.1 of the conveyor 61.1. Air which flows from the radially outermost portion of the inner side of the shroud 75.1 into the suction chambers 91.1 and 92.1 by way of ports 93.1 attracts the batches P1 and ensures their predictable transfer (i.e., advancement with the respective pockets 3.1 of the conveyor 61.1) toward and into contact with the underside of the lower reach of the conveyor 113. It will be seen that, whereas suction in the chamber 78.1 acts upon the radially outermost surfaces of successive batches P1, suction in the chambers 91.1 and 92.1 acts upon the lateral surfaces of such batches on their way toward the conveyor 113. The suction chambers 91.1 and 92.1 end where the batches P1 are sufficiently close to the lower reach of the conveyor 113 to be reliably attracted by the suction chamber 116. If desired, the transfer station UZ1 can accommodate a short plenum chamber which facilitates and promotes the transfer of successive batches P1 from their pockets 3.1 onto the conveyor 113. The pressure in such plenum chamber need not appreciably exceed the atmospheric pressure.

During travel in the intermediate portion 64.1 of the conveyor 61.1, fibrous material T1 of the layers 70.1 which are in the process of being converted (by conveyor 77.1 and suction chamber 78.1) into discrete batches P1 advances toward the suction chambers 91.1 and 92.1 in such a way that the developing batches P1 are separated from each other by gaps L (FIG. 5) of requisite length, namely by gaps corresponding to those shown at L in FIG. 3. The transfer of successive batches P1 at the station UZ1 preferably takes place in such a way that the length of the gaps L remains unchanged.

The batch forming unit PB2 operates in the same way as the unit PB1 to convert fibrous material T2 first into layers or fleeces 70.2 and thereupon into discrete batches P2 which are delivered into oncoming gaps L at a transfer station UZ2. This completes the formation of the composite stream S which thereupon advances toward, through and beyond the equalizing device E in the direction indicated by the arrow 117. The parts of the batch forming unit PB2 are denoted by reference characters which are similar to those utilized to designate the parts of the unit PB1 except that the last digits are changed from "1" to "2".

The construction of the equalizing device E can be identical to that of the equalizing device which is shown in FIG. 2. Therefore, FIG. 3 utilizes the same characters as those shown in FIGS. 1 and 2. The trimmed or equalized stream S is thereupon draped into a web of cigarette paper or the like in a manner which is not shown in FIG. 3. The operation of each of the trimming units E1, E2 is preferably regulated in the same way as described with reference to FIG. 1 (note the monitoring device 50 of FIG. 1). This ensures that the density of the batches P1 can be regulated independently of the density of the batches P2.

The lower reach of the conveyor 113 is adjacent to the perforated bottom wall 114 of the suction chamber 116.

Figure 6:
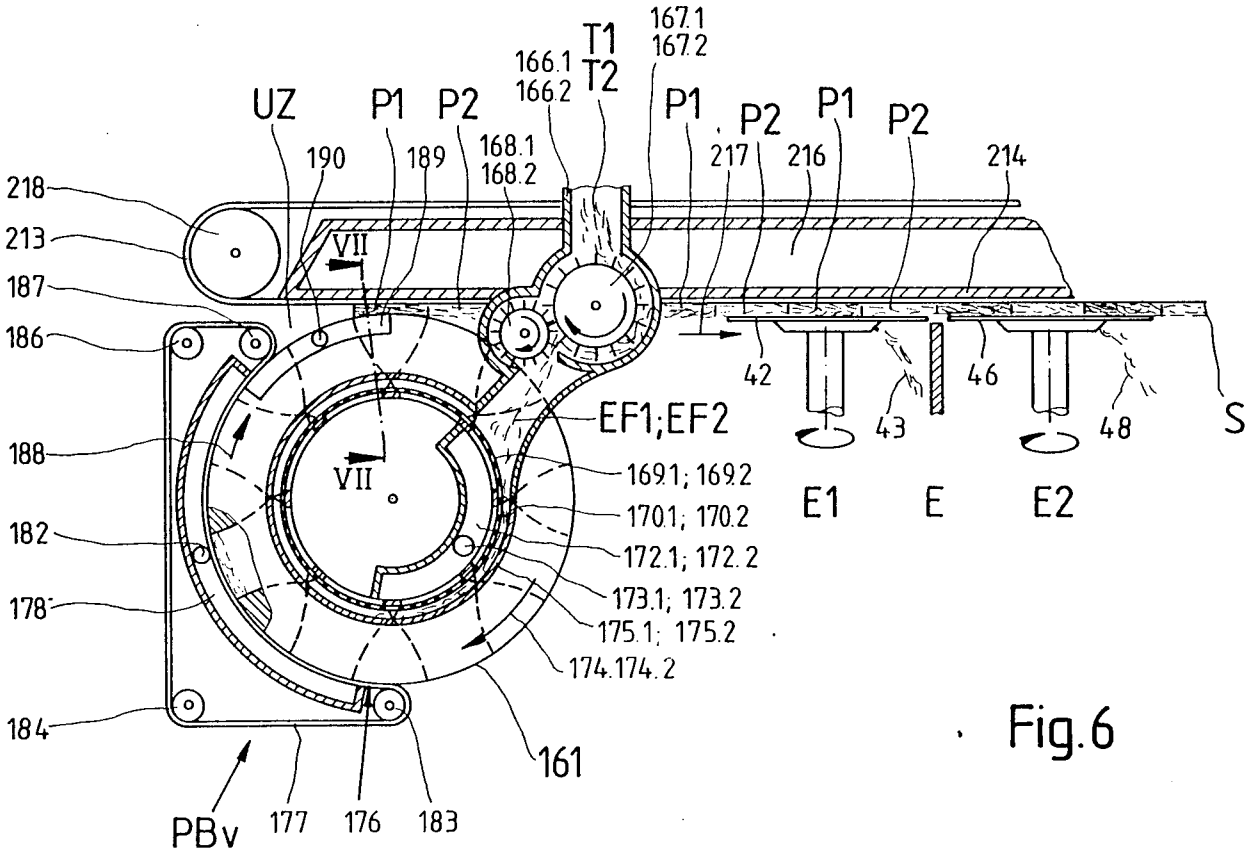
FIG. 6 is a fragmentary partly elevational and partly vertical sectional view of an apparatus constituting a modification of the apparatus which is shown in FIGS. 3 to 5.
Figure 8:
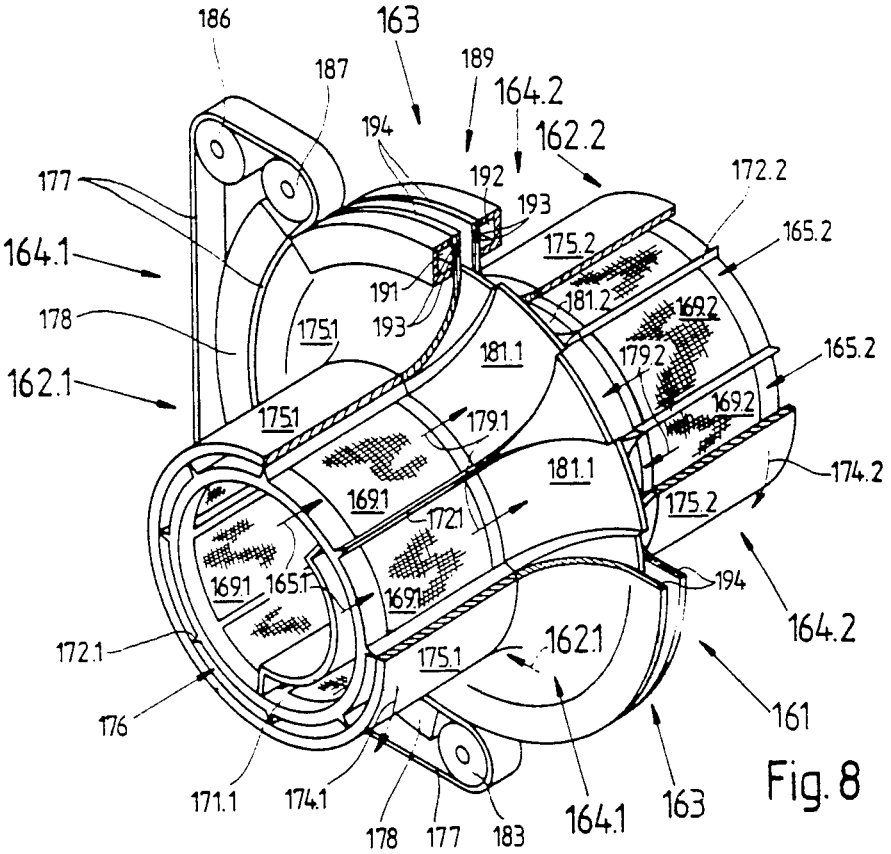
FIG. 8 is an enlarged perspective view of the single rotary wheel-shaped batch forming conveyor in the apparatus of FIG. 6.
Figure 7:
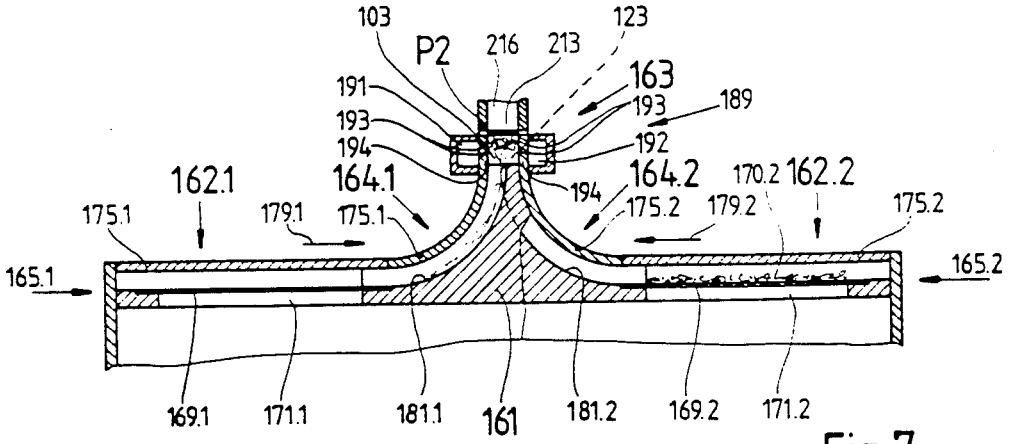
FIG. 7 is an enlarged fragmentary sectional view as seen in the direction of arrows from the line VII—VII in FIG. 6.

FIGS. 6 to 8 illustrate a third apparatus which constitutes a modification of the apparatus of FIGS. 3 to 5. The main difference between the two apparatus is that the apparatus of FIGS. 6 to 8 utilizes a single batch forming unit PBv which has a rotary wheel-shaped conveyor 161 that is common to the means for forming the batches P1 and to the means for forming the batches P2. All such parts of the conveyor 161 which are identical with or clearly analogous to the parts of the conveyor 61.1 of FIGS. 3 to 5 are denoted by similar reference characters plus 100. Those parts which are used to make the batches P1 are denoted by the suffixes "1" and those parts which are used for the making of the batches P2 are denoted by the suffixes "2".

The conveyor 161 comprises a centrally located batch forming portion 163 which is flanked by two layer-forming portions 162.1 and 162.2. The portions 162.1 and 162.2 are mirror symmetrical to each other with reference to the central plane of the conveyor 161, namely a plane which conicides with the plane of FIG. 6. The portions 162.1 and 162.2 respectively comprise layer-forming sections 165.1 and 165.2 with foraminous bottoms 169.1 and 169.2 for the formation of thin layers of fleeces 170.1 and 170.2. To this end, particles of fibrous material which are fed by the ducts 166.1 and 166.2 (such ducts are located behind each other, as seen in FIG. 6) advance into the range of carded drums 167.1 and 167.2 (such drums are also disposed one behind the other, as seen in FIG. 6) and the picker rollers 168.1, 168.2 expel particles of fibrous materials T1 and T2 from the respective cardings to propel them at the locations EF1 and EF2 (such locations are also disposed one behind the other as considered in FIG. 6).

FIG. 8 shows that fibrous material T1 reaches the bottoms 169.1, which are separated from each other by rib-like partitions 172.1, to accumulate into the respective fleeces or layers 170.1. Such layers are attracted to the respective bottoms 169.1 by air which flows through the bottoms 169.1 and into a stationary suction chamber 171.1. The manner in which fibrous material T2 is converted into batches P2 at the other side of the portion 163, namely in the portion 162.2, first into fleeces or layers 170.2 (on the bottoms 169.2 of the sections 165.2) and thereupon pneumatically into batches P2 by increasing the thickness and by simultaneously reducing the width of the layers 170.2, is the same as described above in connection with the batches P1.

The fleeces or layers 170.1 and 170.2 are moved pneumatically in the directions indicated by arrows 174.1, 174.2 to enter the zone 176 wherein they are entrained by air flowing into the suction chamber 178 in the direction of arrows 179.1 and 179.2 (see FIG. 8) so that they advance in opposite directions toward a common foraminous endless belt conveyor 177 on which they form a succession of alternating batches P1 and P2 which are attracted to the conveyor 177 by air flowing into the suction chamber 178. The resulting series of alternating batches P1 and P2 is then transported in the direction of arrow 188 to reach the transfer station UZ where the batches are separated from the belt conveyor 177 (by having advanced beyond the suction chamber 178) and move into the range of the holding means 189 wherein the batches P1 and P2 are attracted to the cheeks 194 of the conveyor 161 via ports 193 which allow air to flow into the adjacent suction chambers 191 and 192. Consequently, the batches P1 and P2 remain on the conveyor 161 during travel all the way to the twelve o'clock position of the conveyor 161 where they reach the underside of the lower reach of the belt conveyor 213. Such lower reach is adjacent to a suction chamber 216 which attracts the thus obtained composite stream S and ensures that the stream advances in the direction of arrow 217 toward, through and beyond the homogenizing and equalizing device E. The trimming units E1 and E2 can operate in the same way as described in connection with FIGS. 1 and 2, i.e., the batches P1 can be trimmed and equalized independently of the batches P2 and vice versa. Consequently, the density of each portion of the trimmed stream S downstream of the equalizing device E matches a preselected value.

The suction chamber 216 has a foraminous bottom wall 214. The conveyor 177 is trained over pulleys 183, 184, 186, 187 and the conveyor 213 is trained over pulleys 218. The character 182 denotes a conduit which connects the suction chamber 178 with a suction generating device. The batch forming station is shown at 176. The pockets of the portion 163 are shown at 103, 123. A conduit 190 connects the suction chambers 191, 192 to a suction generating device.

The parts 164.1, 164.2, 173.1, 173.2, 175.1, 175.2, 179.1, 179.2, 181.1 and 181.2 correspond to the similarly referenced parts of the apparatus which is shown in FIGS. 3–5.

An advantage of the apparatus of FIGS. 3–5 is that the quantity of non-accepted fibrous material is negligible or zero. Moreover, the batches which are obtained from layers are more homogeneous than those which are obtained in response to showering of fibrous material directly into the pockets of a rotating wheel-shaped conveyor. This is due to the fact that the fibrous material of the layers is spread onto large surfaces.

The apparatus of FIGS. 6–8 exhibits the advantages of the apparatus of FIGS. 3–5 as well as the advantage of even greater compactness because it employs a single wheel-shaped conveyor 161. Moreover, the making of batches P2 and the shuffling of such batches with the batches P1 takes place simultaneously with the making of the batches P1. In other words, the transfer of batches P1 onto the conveyor 213 takes place simultaneously with and at the location (station UZ) of the transfer of batches P2.

The equalizing device E exhibits the important advantage that the homogenizing and trimming of batches P1 can take place independently of the homogenizing and trimming of the batches P2, especially if the apparatus further comprises one or more monitoring devices and means for adjusting the trimming units E1 and E2 independently of each other. Such independent adjustability of the units E1 and E2 contributes to greater constancy of one or more important parameters of the composite stream S.

The apparatus can be equipped with two or more monitoring devices each of which monitors a different parameter of the stream S, of the cigarette rod, of the cigarettes and/or of the batches and each of which can transmit signals to the control units 51 and 52. This renders it possible to even more accurately regulate the density and/or mass per unit length of the stream S.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of making a stream of smokable fibrous material, particularly a stream of tabacco, comprising the steps of accumulating first batches from a first smokable fibrous material; gathering second batches from a second smokable fibrous material; and shuffling the first and second batches to form a composite stream wherein first batches alternate with second batches.

2. The method of claim 1, wherein said shuffling step comprises advancing the first batches along an elongated path in the form of a single file wherein neighboring first batches define gaps, and inserting discrete second batches between successive first batches of the file.

3. The method of claim 1 of making a composite stream from elongated batches, wherein said shuffling step includes placing the second batches end-to-end with neighboring first batches.

4. The method of claim 1, wherein said accumulating step includes feeding the first fibrous material into successive pockets of a series of pockets on a first circulating conveyor and said gathering step comprises feeding the second fibrous material into successive pockets of a series of pockets on a discrete second circulating conveyor, said shuffling step comprising transferring first and second batches from the pockets of the first and second conveyors onto an endless belt conveyor.

5. The method of claim 4, wherein the circulating conveyors are rotary wheels having peripheral surfaces with recesses which constitute the pockets, and further comprising the step of positioning the belt conveyor substantially tangentially of the wheels.

6. The method of claim 1, wherein said accumulating step includes feeding the first fibrous material into alternate pockets of an annulus of pockets on a circulating conveyor and said gathering step comprises feeding the second fibrous material into the pockets between the alternate pockets so that the thus filled pockets contain a single file of alternating first and second batches.

7. The method of claim 6, wherein said shuffling step comprises transferring first and second batches from successive pockets of the circulating conveyor onto an endless belt conveyor so that the transferred batches together form the composite stream.

8. The method of claim 1, wherein said accumulating step comprises forming a series of first layers from the first fibrous material and converting each first layer into a first batch, said gathering step comprising forming a series of second layers from the second fibrous material and converting each second layer into a second batch.

9. The method of claim 8, wherein each of said converting steps includes pneumatically increasing the thickness and simultaneously reducing the width of the respective layers.

10. The method of claim 1, wherein said shuffling step comprises transferring the first and second batches onto a driven endless foraminous belt conveyor and advancing the composite stream along a predetermined path, said advancing step including establishing a pressure differential between the opposite sides of the conveyor.

11. The method of claim 1, further comprising the step of equalizing the composite stream.

12. The method of claim 11, further comprising the step of draping the equalized stream into a web of wrapping material.

13. The method of claim 11, wherein said equalizing step comprises removing fibrous material from the composite stream.

14. The method of claim 1, further comprising the step of trimming the composite stream including removing fibrous material from at least some of the batches in such quantities that each first batch contains a first quantity of the first fibrous material and each second batch contains a different second quantity of the second fibrous material.

15. The method of claim 14, wherein said trimming step includes removing fibrous material from each of said batches so that all trimmed first batches contain identical first quantities of the first fibrous material and all trimmed second batches contain identical second quantities of the second fibrous material.

16. The method of claim 14, further comprising the steps of monitoring the quantities of fibrous material in the trimmed batches and changing the rate of material removal when the monitored quantities deviate from at least one predetermined value.

17. The method of claim 16, wherein said trimming step includes removing fibrous material from successive first batches of the composite stream at a first location and removing fibrous material from successive second batches of the composite stream at a second location, said monitoring step including generating first signals denoting the monitored quantities of fibrous material in the first batches and generating second signals denoting the monitored quantities of fibrous material in the second batches, said changing step comprising comparing said first signals with a first reference signal, changing the rate of material removal at the first station when the first signals deviate from the first reference signal, comparing the second signals with a second reference signal, and changing the rate of material removal at the second location when the second signals deviate from the second reference signal.

18. Apparatus for making a stream from smokable fibrous material, particularly a stream of tobacco, comprising means for accumulating a succession of first batches from a first smokable fibrous material; means for gathering a second smokable fibrous material into a succession of second batches; and means for shuffling the first and second batches to form a composite stream wherein first batches alternate with second batches.

19. The apparatus of claim 18, wherein said accumulating means comprises a first circulating conveyor and said gathering means comprises a discrete second circulating conveyor.

20. The apparatus of claim 18, wherein said accumulating and gathering means respectively comprise first and second wheels having peripheral surfaces with annuli of pockets, said accumulating means further comprising means for feeding the first fibrous material into successive pockets of said first wheel and said gathering means further comprising means for feeding the second fibrous material into successive pockets of said second wheel.

21. The apparatus of claim 18, wherein said accumulating means and said forming means comprise a common rotary wheel-shaped conveyor having an annulus of pockets, said accumulating means further comprising first feeding means for supplying the first fibrous material into alternate pockets of said annulus at a predetermined location adjacent to the path of movement of said pockets, said gathering means further comprising means for supplying the second fibrous material to the pockets which remain empty while moving past said location.

22. The apparatus of claim 21, wherein said shuffling means comprises an endless belt conveyor and means for transferring batches from successive pockets of said wheel onto said belt conveyor.

23. The apparatus of claim 22, wherein said transferring means comprises means for attracting the batches to said conveyor by suction.

24. The apparatus of claim 18, wherein at least one of said accumulating and gathering means comprises means for forming layers from the respective fibrous material and means for converting the layers into discrete batches.

25. The apparatus of claim 24, wherein said converting means comprises means for pneumatically increasing the thickness and for simultaneously reducing the width of the layers.

26. The apparatus of claim 18, further comprising means for equalizing the composite stream.

27. The apparatus of claim 26, wherein said equalizing means comprises means for removing fibrous material from at least some batches of the composite stream.

28. The apparatus of claim 26, wherein said equalizing means comprises a first trimming unit having means for removing fibrous material from successive first batches of the composite stream so that each equalized first batch contains a first quantity of fibrous material, and a second trimming unit having means for removing fibrous material from successive second batches of the composite stream so that each equalized second batch contains a different second quantity of fibrous material.

29. The apparatus of claim 28, further comprising means for monitoring the quantities of fibrous material in the equalized batches, means for adjusting said first trimming unit when the monitored quantities of fibrous material in the first batches deviate from a first predetermined value, and means for adjusting said second trimming unit when the monitored quantities of fibrous material in the second batches deviate from a second predetermined value.

30. The apparatus of claim 18, further comprising adjustable means for equalizing the composite stream, means for monitoring the quantities of fibrous material in the batches of the equalized stream, and means for adjusting said equalizing means when the monitored quantities deviate from predetermined values.

31. The apparatus of claim 18, further comprising means for equalizing the composite stream and means for draping the equalized stream into a web of wrapping material.

32. A method of making a rod-like filler of smokable fibrous material, particularly a stream of tobacco, comprising the steps of accumulating first and second smokable fibrous materials into a composite stream wherein first batches of first smokable fibrous material alternate with second batches of second smokable fibrous material; and trimming the composite stream including removing first fibrous material from at least some of said first batches so that the thus trimmed first batches contain first quantities of first fibrous material, and removing second fibrous material from at least some of said second batches so that the thus trimmed second batches contain different second quantities of fibrous material.

33. The method of claim 32, wherein said step of removing the first fibrous material comprises removing first fibrous material from each of said first batches so that all first batches contain identical first quantities of first fibrous material, said step of removing second fibrous material including removing second fibrous material from each of said second batches so that all second batches contain identical second quantities of second fibrous material.

34. The method of claim 33, further comprising the steps of monitoring the quantities of fibrous material in the trimmed batches and changing the rate of material removal when the monitored quantities deviate from at least one predetermined value.

35. The method of claim 33, wherein said step of removing the first fibrous material includes removing first fibrous material from successive first batches at a first location and said step of removing second fibrous material includes removing second fibrous material from successive second batches at a second location, said monitoring step including generating first signals denoting the monitoring quantities of first fibrous material in the first batches and generating second signals denoting the monitored quantities of second fibrous material in the second batches, said changing step comprising comparing said first signals with a first reference signal, changing the rate of material removal at the first station when the first signals deviate from the first reference signal, comparing the second signals with a second reference signal, and changing the rate of material removal at the second location when the second signals deviate from the second reference signal.

36. Apparatus for making a rod-like filler of smokable fibrous material, particularly a stream of tobacco, comprising means for accumulating first and second smokable fibrous materials into a composite stream wherein first batches of first smokable fibrous material alternate with second batches of second smokable fibrous material; and means for trimming the composite stream, including means for removing first fibrous material from at least some of said first batches so that the thus trimmed first batches contain first quantities of first fibrous material, and means for removing second fibrous material from at least some of said second batches so that the thus trimmed second batches contain different second quantities of fibrous material.

37. The method of claim 36, wherein said means for removing the first fibrous material comprises a first trimming unit having means for removing fibrous material from successive first batches of the composite stream so that each equalized first batch contains a first quantity of first fibrous material, said means for removing the second fibrous material comprising a second trimming unit having means for removing fibrous material from successive second batches of the composite stream so that each trimmed second batch contains said different second quantity of fibrous material.

38. The method of claim 37, further comprising means for monitoring the quantities of fibrous material in the trimmed batches, means for adjusting said first trimming unit when the monitored quantities of the first fibrous material in the first batches deviate from said first quantity, and means for adjusting said second trimming unit when the monitored quantities of the second fibrous material in the trimmed second batches deviate from said second quantity.

* * * * *